US011825585B2

(12) United States Patent
Balest et al.

(10) Patent No.: US 11,825,585 B2
(45) Date of Patent: Nov. 21, 2023

(54) METHOD FOR CONTROLLING A COOKING ZONE OF AN INDUCTION COOKING HOB

(71) Applicant: ELECTROLUX APPLIANCES AKTIEBOLAG, Stockholm (SE)

(72) Inventors: Frederico Balest, Forlì (IT); Laurent Jeanneteau, Compiegne (FR); Alex Viroli, Forli (IT); Massimo Nostro, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 400 days.

(21) Appl. No.: 17/059,938

(22) PCT Filed: Jun. 3, 2019

(86) PCT No.: PCT/EP2019/064306
§ 371 (c)(1),
(2) Date: Nov. 30, 2020

(87) PCT Pub. No.: WO2019/238447
PCT Pub. Date: Dec. 19, 2019

(65) Prior Publication Data

US 2021/0212176 A1 Jul. 8, 2021

(30) Foreign Application Priority Data

Jun. 16, 2018 (EP) ..... 18178150

(51) Int. Cl.
*H05B 6/12* (2006.01)
*H05B 6/06* (2006.01)

(52) U.S. Cl.
CPC ..... *H05B 6/1272* (2013.01); *H05B 6/062* (2013.01); *H05B 2206/02* (2013.01); *H05B 2213/05* (2013.01)

(58) Field of Classification Search
CPC .. H05B 6/062; H05B 6/1272; H05B 2213/05; H05B 2206/02
See application file for complete search history.

(56) References Cited

U.S. PATENT DOCUMENTS

2016/0037589 A1* 2/2016 Altamura ..... F24C 15/106 219/465.1

FOREIGN PATENT DOCUMENTS

EP 2525485 11/2012
EP 2999304 3/2016
(Continued)

OTHER PUBLICATIONS

EP communication for application No. EP 19727034.1, dated Sep. 28, 2021, 3 pages.
(Continued)

*Primary Examiner* — Dana Ross
*Assistant Examiner* — Kuangyue Chen
(74) *Attorney, Agent, or Firm* — Pearne & Gordon LLP

(57) ABSTRACT

The present invention relates to a method for controlling a cooking zone (16) of an induction cooking hob, wherein said cooking zone (16) comprises at least one induction coil (16) and is supplied by a generator (14) including a power switch. The method is performed by controlling the power switch by a gate driving signal (18) including a deactivation pulse length (Toff) and an activation pulse length (Ton). A switching period (T) of the gate driving signal (18) is given by the sum of the activation pulse length (Ton) and deactivation pulse length (Toff). A driving frequency (f) of the power switch is the reciprocal value of said switching period (T). The deactivation pulse length (Toff) depends on the resistance (28) and the inductance (30) of the induction coil (16). The activation pulse length (Ton) is varied according to a requested power for the cooking zone (16). A series of
(Continued)

Figure 1:
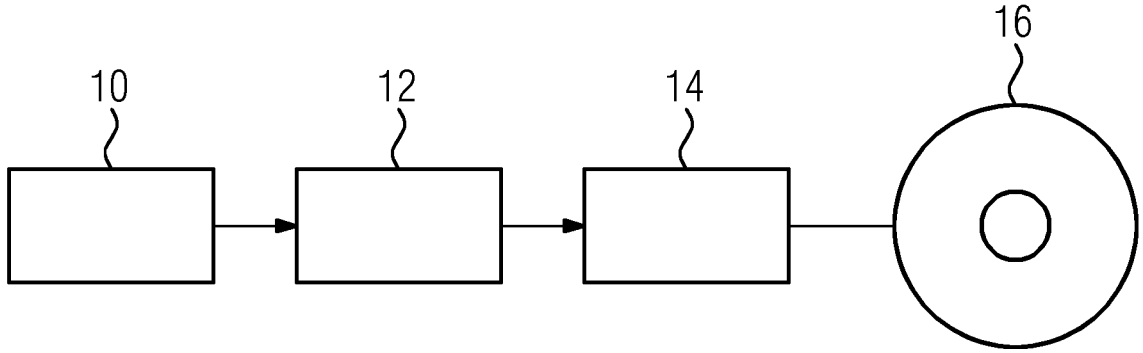

constant activation pulse length (Ton) is activated in order to determine the optimal deactivation pulse length (Toff).

18 Claims, 5 Drawing Sheets

(56) References Cited

FOREIGN PATENT DOCUMENTS

| | | | | |
|---|---|---|---|---|
| EP | 3582586 | | 12/2020 | |
| WO | 2013064331 | | 5/2013 | |
| WO | WO-2013064331 | A1 * | 5/2013 | ..... H05B 6/062 |

OTHER PUBLICATIONS

International Search Report and Written Opinion for PCT/EP2019/064306 dated Sep. 4, 2019, 7 pages.

* cited by examiner

METHOD FOR CONTROLLING A COOKING ZONE OF AN INDUCTION COOKING HOB

The present invention relates to a method for controlling a cooking zone of an induction cooking hob. Further, the present invention relates to an induction cooking hob.

In a cooking zone of an induction cooking hob acoustic noise may occur due to frequency jittering. Said frequency jittering is an undesirable and unavoidable effect in oscillator circuits.

WO 2013/064331 A1 discloses an induction heating cooker. A power switch is controlled by a gate driving signal including a conducting time Ton and a non-conduction time Toff. The conducting time Ton depends on the power level adjustment performed by the user. The non-conduction time Toff depends on the resistance and inductance of the induction coil. A comparator compares the output voltage of a rectifier with the resonant voltage at a collector node of the power switch in order to detect the presence and characteristic features of a cooking vessel and to determine and update the non-conduction time Toff of the power switch.

EP 2 999 304 A1 discloses a method for operating an induction cooking hob. The alternating current flow through the induction coil is activated by an enabling signal with a variable pulse duration. When starting the heating process, the duration of enabling signal pulses is reduced in order to reduce the acoustic noise.

EP 2 999 304 A1 discloses an induction cooking hob, wherein a power switch is controlled by a signal comprising pulses. The power is adjusted by the duration of said pulses. A reduction of the duration of the pulses reduces acoustic noise due to a high switch-on current.

It is an object of the present invention to provide a method for controlling a cooking zone of an induction cooking hob, which reduces acoustic noise due to frequency jittering and determines the optimal deactivation pulse length by low complexity.

According to the present invention a method for controlling a cooking zone of an induction cooking hob is provided, wherein said cooking zone comprises at least one induction coil and is supplied by a generator including a power switch, and wherein the method is performed by:

- controlling the power switch by a gate driving signal including a deactivation pulse length Toff and an activation pulse length Ton,
- wherein a switching period T of the gate driving signal is given by the sum of the activation pulse length Ton and deactivation pulse length Toff,
- wherein a driving frequency f of the power switch is the reciprocal value of said switching period T,
- wherein the deactivation pulse length Toff depends on the resistance and inductance of the induction coil,
- wherein the activation pulse length Ton is varied according to a requested power for the cooking zone, and
- wherein a series of constant activation pulse length Ton is activated in order to determine the optimal deactivation pulse length Toff.

The core of the present invention is that the deactivation pulse length Toff is assumed to be constant, while the activation pulse length Ton is varied according to the requested power, on the one hand, and the determination of the optimal deactivation pulse length Toff by the activation of the series of constant activation pulse length Ton on the other hand. The gate driving signal is only controlled by variation of the activation pulse length Ton. This reduced frequency jittering and the resulting acoustic noise. The activation of the series of constant activation pulse length Ton does not require any additional hardware. Factually, the optimal deactivation pulse length Toff is determined by multiple activation of the power switch.

Preferably, the deactivation pulse length Toff is constant for a certain combination of the induction coil and a cooking vessel.

Further, the deactivation pulse length Toff may depend on the final resistance and inductance values when the cooking vessel is placed on the cooking zone. The combination of the constant deactivation pulse length Toff and the variable activation pulse length Ton is an essential property of the present invention.

In particular, the deactivation pulse length depends on the resistance, inductance and capacity of a system formed by the induction coil and a cooking vessel.

In this case, the capacity depends on the position of the cooking vessel above the induction coil.

Preferably, the deactivation pulse length Toff is detected after the generator has been activated.

If the detected deactivation pulse length Toff is within a predefined range, then the power switch is driven. Otherwise, the generator is stopped.

For example, the constant activation pulse length is activated five to twenty times, preferably ten to fifteen times.

Moreover, the constant activation pulse length Ton may be between six and forty microseconds, preferably about eleven microseconds.

Further, the presence and/or the position of the cooking vessel are detected.

In general, the method is realized in hardware, software or a combination of hardware and software.

Moreover, the present invention relates to an induction cooking hob adapted to execute a method as discussed above.

In particular, the induction cooking hob comprises at least one analogue-digital converter. Preferably, said analogue-digital converter is integrated within a micro controller of the induction cooking hob.

The analogue-digital converter may be provided for detecting the shapes of voltage and/or current of the power switch of the induction cooking hob.

At last, the present invention relates to a computer program product stored on a computer usable medium, comprising computer readable program means for causing a computer to perform a method mentioned above.

Figure 2:
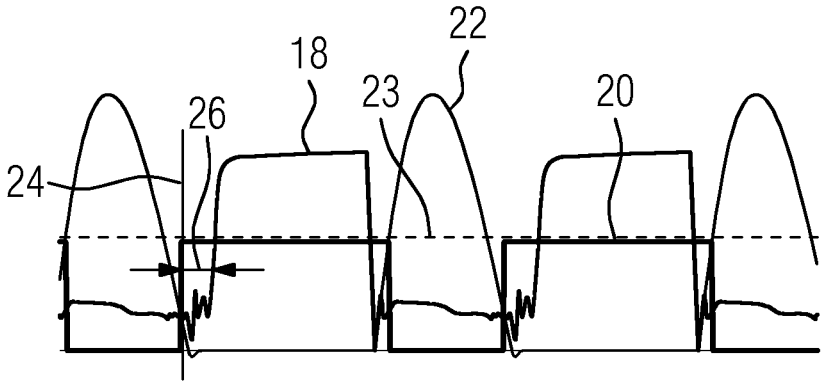
Figure 3:
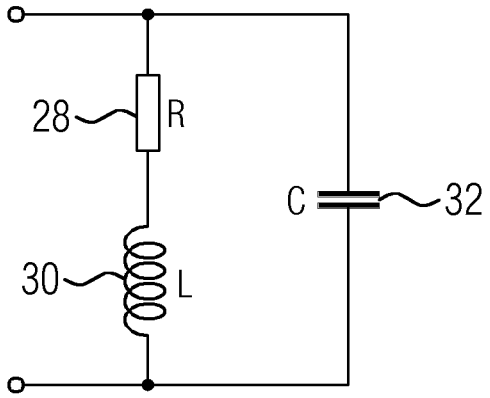
Figure 4:
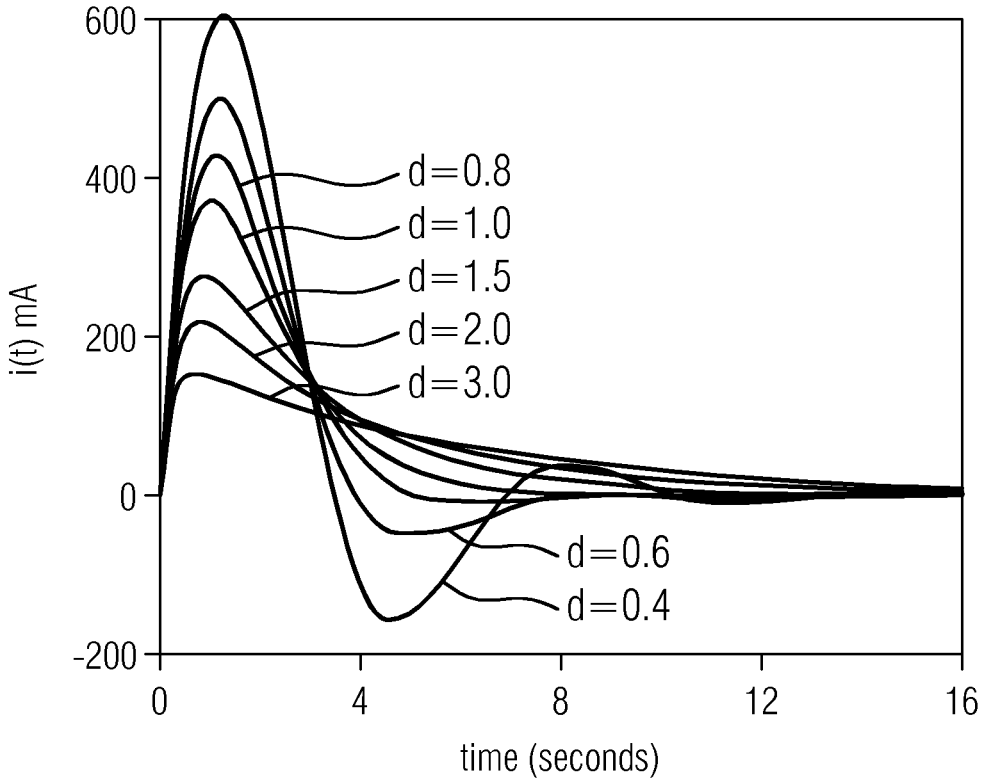
Figure 5:
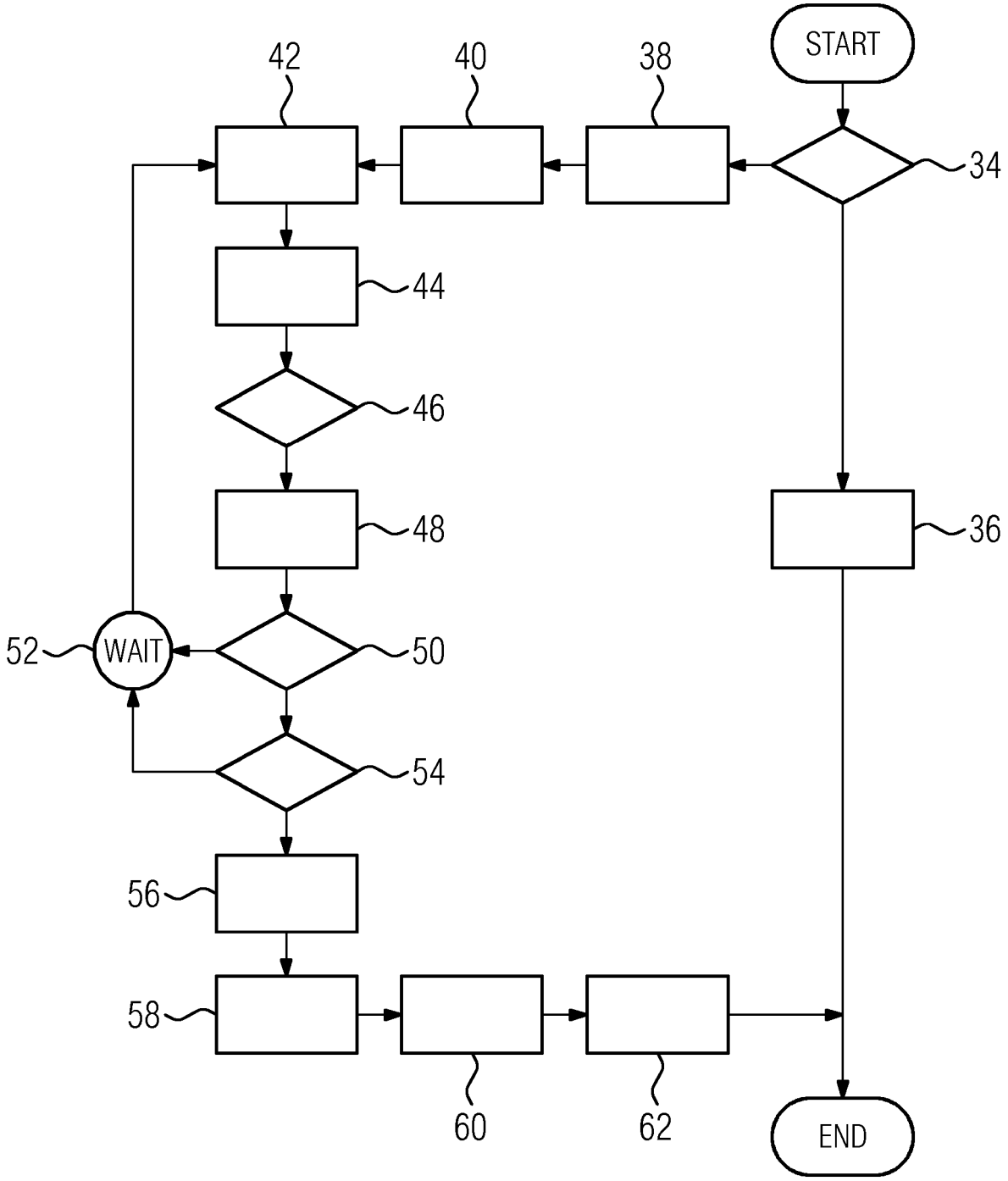
Figure 6:
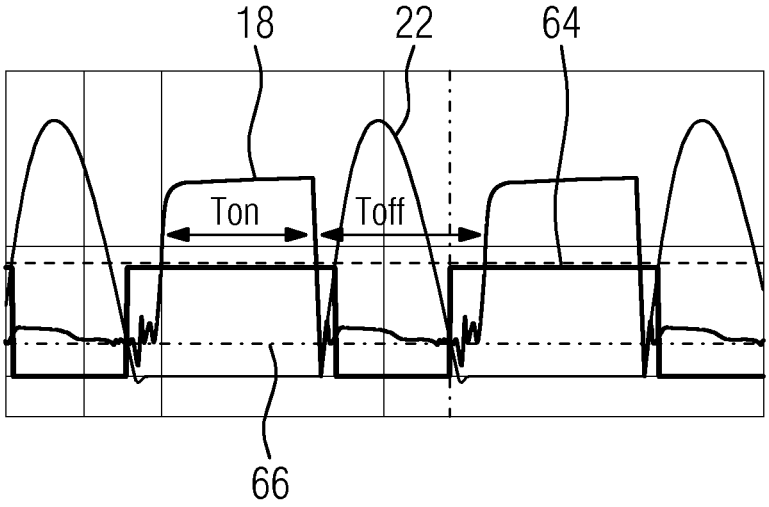
Figure 7:
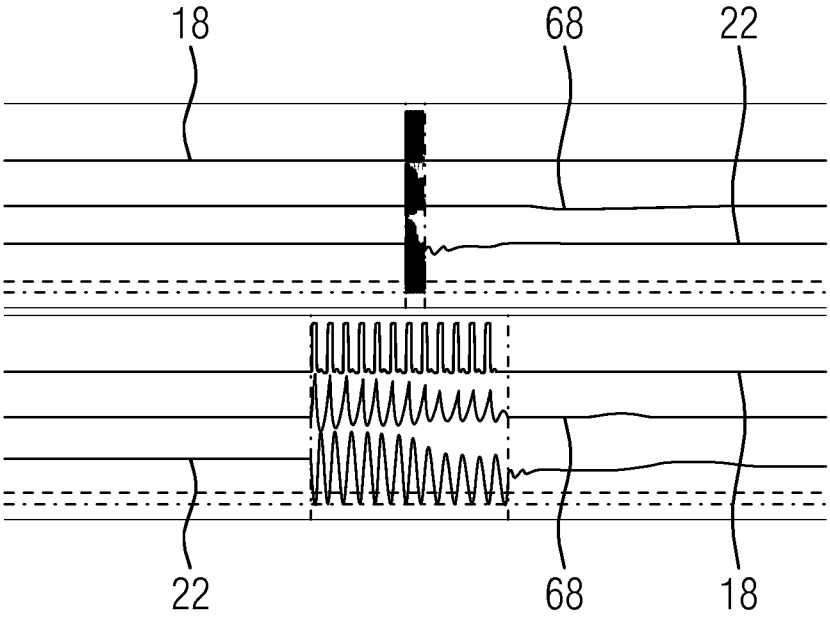
Figure 8:
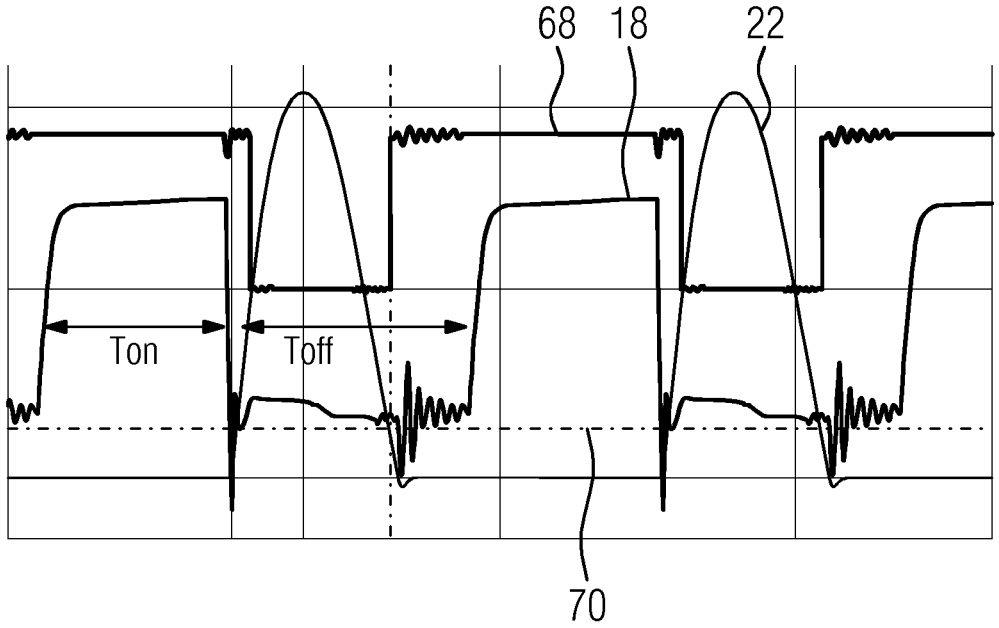

The present invention will be described in further detail with reference to the drawing, in which FIG. 1 illustrates a schematic diagram of a circuit for a cooking zone of an induction cooking hob according to a preferred embodiment of the present invention, FIG. 2 illustrates a schematic time diagram of an automatic trigger pulse width modulation mode for the cooking zone of the induction cooking hob according to the prior art, FIG. 3 illustrates a schematic equivalent circuit diagram of the cooking zone of the induction cooking hob with a cooking vessel, FIG. 4 illustrates a schematic time diagram of a damped oscillation with several damping parameters, FIG. 5 illustrates a schematic flow chart diagram of an algorithm for evaluating a pulse width and detecting a cooking vessel according to the preferred embodiment of the present invention, FIG. 6 illustrates a schematic time diagram of an example of an automatic trigger pulse width modulation mode for the cooking zone of the induction cooking hob according to a preferred embodiment of the present invention, FIG. 7 illustrates a detailed time diagram of the calculation of the deactivation pulse length and the detection of the presence of the cooking vessel according to the present invention, and FIG. 8 illustrates a schematic time diagram of the activation of the free running pulse width modulation mode for the induction coil of the induction cooking hob according to the present invention.

FIG. 1 illustrates a schematic diagram of a circuit for a cooking zone of an induction cooking hob according to a preferred embodiment of the present invention.

The circuit comprises a user interface 10, a micro controller 12, a generator 14 and an induction coil 16. Instead of the induction coil 16, the cooking zone may comprise two or more induction coils 16, wherein said induction coils 16 are supplied with the same frequency by the generator 14.

The user interface 10 is operated by the user. In particular, the user selects a requested power for the induction coil 16. The micro controller 12 controls the generator 14. The generator 14 supplies the induction coil 16 with frequencies corresponding with the requested power. In this example, the generator 14 is a quasi-resonant generator. The generator 14 includes a power switch, e.g. an IGBT. The induction coil 16 provides alternating magnetic fields for generating eddy currents in ferromagnetic portions of cooking utensils on the induction cooking hob in order to heating up said cooking utensils.

Preferably, the circuit includes at least one analogue-digital converter. For example, the analogue-digital converter is integrated within the micro controller 12.

FIG. 2 illustrates a schematic time diagram of an automatic trigger pulse width modulation (PWM) mode for the induction coil 16 of the induction cooking hob.

The time diagram shows a gate driving signal 18 for the power switch, an input trigger signal 20 and a Vce signal 22. Usually, the power switch is an IGBT.

An activation pulse length Ton of the gate driving signal 18 for the power switch is set. The activation pulse length Ton imposes a deactivation pulse length Toff of the gate driving signal 18. Said deactivation pulse length Toff is maintained until the input trigger signal 20 across the power switch does not fall below a correct switching threshold value 23 defined for the component. Otherwise, the generator 14 may be damaged or affected by significant power losses, which reduce lifetime of said generator 14. In the state of the art, the switching is triggered with the defined threshold value 23 via a hardware feedback, wherein said method is called auto trigger pulse width modulation (PWM) mode.

The automatic trigger pulse width modulation mode allows driving the generator 14 and the power switch in a correct manner. However, the automatic trigger pulse width modulation mode is affected by acoustic noise due to frequency jittering, high electrical noise sensitivity and/or power variation within the mains cycle. A trigger event 24 occurs when the Vce signal 22 crosses during a falling phase a threshold value of about zero volts, which is lower than the threshold value 23. Said trigger event 24 changes the status of the input trigger signal 20 from low to high.

FIG. 3 illustrates a schematic equivalent circuit diagram of the induction coil 16 with a cooking vessel on the induction cooking hob.

The equivalent circuit diagram of the induction coil 16 with the cooking vessel includes a resistance 28, an inductance 30 and a capacity 32. The resistance 28 and inductance 30 are switched in series. The capacity 32 is switched parallel to the series of the resistance 28 and inductance 30. The resistance 28 and inductance 30 are properties of the induction coil 16. The resistance 28 and inductance 30 are formed by the coil windings and then modified by the coupling of the induction coil 16 and the cooking vessel. The capacity 32 is formed by a separate physical component, has a constant value and is independent of the coil windings.

FIG. 4 illustrates schematic time diagrams of a damped oscillation with several damping factors d. In this example, the time diagrams for the damping factors d=0.4, d=0.6, d=0.8, d=1.0, d=1.5, d=2.0 and d=3.0 are shown. The oscillation is undamped if the damping factor is d=0, underdamped if the damping factor is d<1, critically if the damping factor is d=1, and overdamped if the damping factor is d>1. In this case, the damping factor d is about 0.005, so that the system is underdamped.

The model of the damped oscillation is applied to a quasi-resonant generator. The Vce signal 22 is about zero volts when the power switch is in an on-state, while said Vce signal 22 has an under-damped response when the power switch is in an off-state. The Vce signal 22 has a decaying oscillation at a frequency derived from a pulsation of ω*d and a fixed level of a potential difference Vdc, wherein the co is the frequency. The potential difference Vdc is the level between two extreme points of the RLC circuit shown in FIG. 3. In this case, the damping factor d is about 0.005, wherein the curve is similar as d=0.4 in FIG. 4, but with higher amplitude. The first zero-crossing occurs after the first oscillation.

Said level becomes the steady state condition final value, which is the main difference to the model in FIG. 4. The decay rates of the observed signals are determined by the attenuation a given by $$\alpha=R/(2*L)=\omega*d,$$

wherein R is the resistance and L is the inductance of the induction coil 16, while the damping factor d describes the envelope of the oscillation.

The deactivation pulse length Toff is defined as the time required by the response to reach minimum level in the first oscillation period, while the activation pulse length Ton is the time in which the power switch is controlled in an on-state and the Vce signal 22 is kept at zero.

The power switch can properly operate with a switching period T given by:

$$T=T\text{on}+T\text{off},$$

while the driving frequency f is given by:

$$f=1/T.$$

The driving frequency f is imposed by the switching period T=Ton+Toff according to the power request. In contrast, the frequency ω mentioned above relates to free oscillations of the system. Thus, the driving frequency f and the frequency ω are different due to the phase during the deactivation pulse length Toff, wherein the Vdc is forced to zero.

Assuming that the deactivation pulse length Toff is a constant characteristic of the system, the power delivered to the cooking vessel by the generator 14 only depends on the current through the induction coil 16, and hence on the activation pulse length Ton.

Changing the activation pulse length Ton according to a desired target power it becomes evident that the switching period P and the driving frequency f are changed, since the deactivation pulse length Toff is constant for the coupling of the induction coil 16 with the cooking vessel.

Thus, the power is controlled by the driving frequency f using only the activation pulse length Ton as variable, while the deactivation pulse length Toff is set when the generator is in the on-state and if the result is inside a predefined range provided for driving the power switch as expected. The generator 14 is stopped and the measurement is repeated, if the working conditions, e.g. the coupling between the induction coil 16 and the cooking vessel, change during the normal operation.

FIG. 5 illustrates a schematic flow chart diagram of an algorithm for evaluating the deactivation pulse length Toff and detecting the cooking vessel according to the preferred embodiment of the present invention.

The switching periods depend on the hardware characteristics. A suitable method for obtaining the correct evaluation of the deactivation pulse length Toff is the automatic trigger pulse width modulation (PWM) mode according to selected operating conditions. In particular, the automatic trigger PWM mode is activated for a short interval, in which a numbered sequence of switching pulses is generated. The time distance between each feedback, set by a dedicated hardware properly designed for this role, is saved in multiple records. These data are elaborated to calculate the deactivation pulse length Toff, wherein the activation pulse length Ton selected for measuring an average period Tave is the minimum allowed by the system called.

When the method has been started, the power is checked in step 34. Step 34 checks the condition, if the power is zero. If the condition in step 34 is fulfilled, i.e. the power is zero, then the generator 14 and the power control are stopped in step 36. If the condition in step 34 is not fulfilled, i.e. the power is not zero, then the evaluation of the deactivation pulse length Toff is started in step 38. Then, an automatic trigger hardware circuit is enabled and a fixed activation pulse length Ton is set in step 40. After that, the first pulse for driving the power switch is launched in step 42. Then, the automatic trigger signal period is measured in step 44.

In step 46, it is checked, if the measurement in step 44 has reached the target number. If the condition of step 46 is not fulfilled, then the measurement of the automatic trigger signal period in step 44 repeated. If the condition of step 46 is fulfilled, then an automatic trigger circuit is disabled and the activation pulse length Ton is reset in step 48.

Then, in step 50 is checked, if the minimum number of measurements is within the range. If the condition in step 50 is not fulfilled, then a time warp is activated in step 52 and the method returns to step 42 again, wherein the first pulse for driving the power switch is launched. If the condition in step 50 is fulfilled, then the presence of the cooking vessel is checked in step 54. The detection of the presence of the cooking vessel is necessary in order to ensure that the cooking vessel has been properly placed on the area of the cooking zone.

If the condition of step 54 is not fulfilled, i.e. the cooking vessel is absent, then the time warp is activated in step 52 and the method returns to step 42 again, wherein the first pulse for driving the power switch is launched. If the condition of step 54 is fulfilled, i.e. the cooking vessel is present, then the average of the automatic trigger measurements is calculated in step 56. Then, the deactivation pulse length Toff is calculated in step 58. After that, the deactivation pulse length Toff is applied and a minimum and maximum driving frequency are defined in step 60. At last, in step 62 the generator 14 is started and the power in free running PWM mode is activated.

The free running PWM mode starts with the parameters $$Toff = Tave - Min(Ton),$$

$$f = 1/(Ton + Toff),$$

wherein the activation pulse length Ton for the free running PWM mode is the variable controlled in order to meet the requested power acting on the driving frequency f.

FIG. 6 illustrates a schematic time diagram of an example of an automatic trigger pulse width modulation (PWM) mode for the induction coil 16 of the induction cooking hob according to the present invention.

The time diagram includes the gate driving signal 18, the Vce signal 22 and an automatic trigger feedback signal 64. The diagrams shown in FIG. 2 and FIG. 6 relate to the same driving method. However, the diagrams of FIG. 2 serve power delivering, while the diagram of FIG. 6 serves the management process of the deactivation pulse length Toff. In both case, the Vce signal 22 crosses a threshold value close to zero volts, which triggers a change of the status of the input trigger signal 20 from low to high at the trigger event 24. After the delay 26 of 3 μs, the gate driving signal 18 will be activated. The input trigger signal 20 in FIG. 2 and the automatic trigger feedback signal 64 in FIG. 6 are similar.

After the Vce signal 22 crosses a defined threshold value 66, the automatic trigger feedback signal 64 rises regularly. The threshold value 66 is different from the threshold value 23 in FIG. 2.

Then, the gate driving signal 18 rises after a fixed delay and the power switch is activated. Said delay guarantees that the minimum level of the Vce signal 22 has been reached when the power switch is activated. In this example, the threshold value 66 is 150 V and the delay is 4 μs.

FIG. 7 illustrates a detailed time diagram of the calculation of the deactivation pulse length Toff and the detection of the presence of the cooking vessel according to the present invention.

The detailed time diagram shows the gate driving signal 18, the Vce signal 22 and a coil sampled current 68. The activation pulse length Ton is 11 μs. The average is 34 μs at a driving frequency f of 30 kHz. The target number of measurements is ten.

Preferably, the activation pulse length Ton is constant. In general, the activation pulse length Ton is between six and forty microseconds.

The deactivation pulse length Toff is given by:

$$Toff = Tave - Min(Ton) = 34\ \mu s - 11\ \mu s = 23\ \mu s,$$

And the frequency f is given by:

$$f = 1/(Ton + Toff) = 1/(20\ \mu s + 23\ \mu s)$$

$$= 1/43\ \mu s = 23.3\ \text{kHz}$$

FIG. 8 illustrates a schematic time diagram of the activation of the free running pulse width modulation (PWM) mode for the induction coil 16 of the induction cooking hob according to the present invention. The time diagram relates to the parameters calculated above.

The time diagram shows the gate driving signal 18, the Vce signal 22 and the automatic trigger feedback signal 64. Further, the time diagram shows the threshold value 66. In this example, a triggering threshold value 70 is 150 V.

After the Vce signal 22 crosses the defined triggering threshold value 70, the coil sampled current 68 rises regularly. However, the activation of the power switch is not synchronised with the trigger set. The minimum level of the coil sampled current 68 is guaranteed by the reduced acoustic noise reduction due to frequency jittering, the electrical noise immunity during activation of the power switch and the stability of the power within the mains cycle.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 user interface
12 micro controller
14 generator
16 cooking zone, induction coil
18 gate driving signal
20 input trigger signal
22 Vce signal
23 threshold value
24 trigger event
26 delay
28 resistance of the induction coil
30 inductance of the induction coil
32 capacity of the induction coil and cooking vessel
34 step of checking the power
36 step of stopping the generator and the power control
38 step of starting the evaluation of the deactivation pulse length Toff
40 step of enabling the automatic trigger hardware circuit and setting the fixed activation pulse length Ton
42 step of launching the first pulse for driving the power switch
44 step of measuring the automatic trigger signal period
46 step of checking if the measurement in step 44 has reached the target number
48 step of disabling the automatic trigger circuit and resetting the activation pulse length Ton
50 step of checking if the minimum number of measurements is within the range
52 step of delaying
54 step of checking the presence of the cooking vessel
56 step of calculating the average of the automatic trigger period measurements
58 step of calculating the deactivation pulse length Toff
60 step of applying the deactivation pulse length Toff and defining a minimum and maximum driving frequency
62 step of starting the generator and activating the power in the free running PWM mode
64 automatic trigger feedback signal
66 threshold value
68 coil sampled current
70 triggering threshold value
Ton activation pulse length
Toff deactivation pulse length
Tave average period
T switching period
f driving frequency
ω frequency
α attenuation
d damping factor
R resistance of the induction coil
L inductance of the induction coil

The invention claimed is:

1. A method for controlling a cooking zone of an induction cooking hob, wherein said cooking zone comprises at least one induction coil and is supplied by a generator including a power switch, and wherein the method comprises:

controlling the power switch by a gate driving signal including a deactivation pulse length and a variable activation pulse length, wherein a free running switching period of the gate driving signal is given by a sum of the variable activation pulse length and the deactivation pulse length, wherein a driving frequency of the power switch is a reciprocal value of said free running switching period, wherein the deactivation pulse length depends on a resistance and an inductance of the induction coil, wherein the variable activation pulse length is varied according to a requested power for the cooking zone, and wherein a series of constant activation pulse lengths is activated in order to determine an optimal length of the deactivation pulse length.

2. The method according to claim 1, wherein the deactivation pulse length is constant for a certain combination of the induction coil and a cooking vessel.

3. The method according to claim 1, wherein the deactivation pulse length depends on final resistance and inductance values when a cooking vessel is placed on the cooking zone.

4. The method according to claim 1, wherein the deactivation pulse length depends on resistance, inductance and capacity of a system formed by the induction coil and a cooking vessel.

5. The method according to claim 4, wherein the capacity depends on a position of the cooking vessel above the induction coil.

6. The method according to claim 1, wherein the deactivation pulse length is detected after the generator has been activated.

7. The method according to claim 6, wherein if a detected deactivation pulse length is within a predefined range, then the power switch is driven, otherwise the generator is stopped.

8. The method according to claim 1, wherein the constant activation pulse length is activated five to twenty times.

9. The method according to claim 1, wherein the constant activation pulse length is between six and forty microseconds.

10. The method according to claim 1, wherein a presence and/or a position of a cooking vessel are detected.

11. The method according to claim 1, wherein the method is executed via hardware, software or a combination of hardware and software.

12. An induction cooking hob adapted to execute the method according to claim 1 on said cooking zone.

13. The induction cooking hob according to claim 12, further comprising at least one analogue-digital converter integrated within a micro controller of said induction cooking hob.

14. The induction cooking hob according to claim 13, wherein the analogue-digital converter is adapted to detect shapes of voltage and/or current of the power switch of the induction cooking hob.

15. A computer program product stored on a non-transitory computer usable medium, comprising computer readable instructions for causing a computer to perform the method according to claim 1 when executed by the computer.

16. A method for controlling a cooking zone of an induction cooking hob, wherein said cooking zone comprises at least one induction coil and is supplied by a generator including a power switch driven by a gate driving signal including a deactivation pulse length and a variable activation pulse length, and wherein the method comprises:

activating a series of constant activation pulse lengths;

measuring an automatic trigger signal period for each of the activated constant activation pulse lengths;

calculating an average of the automatic trigger signal periods;

determining the deactivation pulse length based on the average of the automatic trigger signal periods; and controlling the power switch by the gate driving signal, wherein a free running switching period of the gate driving signal is a sum of the variable activation pulse length and the deactivation pulse length, wherein a driving frequency of the power switch is a reciprocal value of said free running switching period, wherein the deactivation pulse length depends on a resistance, inductance, and capacity of a system formed by the induction coil and a cooking vessel, and the capacity depends on a position of the cooking vessel above the induction coil, and wherein the variable activation pulse length depends on a desired power of the cooking zone.

17. The method according to claim 16, wherein the deactivation pulse length is a difference between the average of the automatic trigger signal periods and a minimum activation pulse length.

18. The method according to claim 16, wherein the deactivation pulse length is constant, and the free running switching period and the driving frequency of the gate driving signal vary as the variable activation pulse length varies based on a varying desired power of the cooking zone.

* * * * *